US009784416B2

(12) United States Patent
Deregibus

(10) Patent No.: US 9,784,416 B2
(45) Date of Patent: Oct. 10, 2017

(54) MULTI-COLOURED LIGHT SOURCES

(75) Inventor: Gianluca Deregibus, Balzola (IT)

(73) Assignee: SCHREDER, Brussels (BE)

( * ) Notice: Subject to any disclaimer, the term of this patent is extended or adjusted under 35 U.S.C. 154(b) by 222 days.

(21) Appl. No.: 14/395,678

(22) PCT Filed: Apr. 27, 2012

(86) PCT No.: PCT/EP2012/057868

§ 371 (c)(1),
(2), (4) Date: Oct. 20, 2014

(87) PCT Pub. No.: WO2013/159834

PCT Pub. Date: Oct. 31, 2013

(65) Prior Publication Data

US 2015/0109774 A1 Apr. 23, 2015

(51) Int. Cl.

| | |
|---|---|
| ***F21K 9/00*** | (2016.01) |
| ***F21K 9/62*** | (2016.01) |
| *F21Y 115/10* | (2016.01) |
| *F21Y 113/13* | (2016.01) |

(52) U.S. Cl.

CPC ..... *F21K 9/00* (2013.01); *F21K 9/62* (2016.08); *F21Y 2113/13* (2016.08); *F21Y 2115/10* (2016.08)

(58) Field of Classification Search

CPC ..... F21K 9/00; F21K 9/54; F21Y 2113/005; G02B 5/045; G09F 2013/222

See application file for complete search history.

(56) References Cited

U.S. PATENT DOCUMENTS 4,271,408 A * 6/1981 Teshima ..... G08G 1/095 340/815.45
6,237,290 B1 * 5/2001 Tokimoto ..... G09F 9/33 40/452
2004/0218387 A1 11/2004 Gorlach (Continued)

FOREIGN PATENT DOCUMENTS

| | | | |
|---|---|---|---|
| EP | 2426716 | A2 | 3/2012 |
| WO | WO2008135927 | A1 | 11/2008 |
| WO | WO2012020597 | A1 | 2/2012 |

OTHER PUBLICATIONS

ISA/EP International Search Report issued Nov. 28, 2012 re PCT Application No. PCT/EP2012/057868, filed Apr. 27, 2012.

(Continued)

*Primary Examiner* — Robert May
*Assistant Examiner* — Leah S Macchiarolo
(74) *Attorney, Agent, or Firm* — Patrick J. Daugherty; Driggs, Hogg, Daugherty & Del Zoppo Co., LPA

(57) ABSTRACT

Described herein is a light array for luminaires which comprises a plurality of coloured light-emitting diode (LED) elements that are arranged within the array to provide better uniformity of illumination. The light array may be rectangular and include equal numbers of colored LED elements of four colors. The red LED elements are grouped towards the center of the light array with the other colors dispersed throughout the array. Two or more light arrays can be placed adjacent one another to increase the illumination produced whilst maintaining the benefit of better uniformity of illumination.

16 Claims, 5 Drawing Sheets

(56) References Cited

U.S. PATENT DOCUMENTS

| | | | | |
|---|---|---|---|---|
| 2005/0117181 | A1* | 6/2005 | Hokoi | H04N 1/0282 358/302 |
| 2005/0122487 | A1* | 6/2005 | Koyama | A47F 11/06 353/94 |
| 2006/0023448 | A1* | 2/2006 | Mok | F21K 9/00 362/231 |
| 2010/0001648 | A1* | 1/2010 | De Clercq | H05B 33/0821 315/113 |
| 2010/0195350 | A1* | 8/2010 | Schattinger | G09F 9/33 362/612 |
| 2011/0037080 | A1 | 2/2011 | Emerson et al. | |
| 2011/0267813 | A1 | 11/2011 | Kubota | |
| 2012/0068615 | A1 | 3/2012 | Duong et al. | |
| 2012/0098434 | A1 | 4/2012 | Sondericker, III | |
| 2016/0125772 | A1* | 5/2016 | Li | G09F 13/18 40/544 |

OTHER PUBLICATIONS

EPO Communication under Rule 71(3) EPC dated Feb. 16, 2017 re European patent application of Schreder, No. 12720838.8.

* cited by examiner

MULTI-COLOURED LIGHT SOURCES

FIELD OF THE INVENTION

The present invention relates to improvements in or relating to multi-coloured light sources, and is more particularly concerned with luminaires having improved colour mixing and uniformity.

BACKGROUND TO THE INVENTION

Luminaires are used for many lighting applications including outdoor lighting, general illumination, facade illumination, and feature illumination, for example, of statues and fountains. In these applications, dynamic colour lighting schemes may be implemented by controlling the operation of the lighting elements within the luminaires One example of illuminating a building facade is described in EP-A-2116761 where multiple asymmetric beams produced by a group of light-emitting diode (LED) elements position under a lens unit are combined at the surface to be illuminated.

Luminaires may comprise an array or matrix of light-emitting diode (LED) elements having one or more colours, and, in multi-coloured luminaires, coloured LED elements, such as, red (R), green (G) and blue (B) LED elements placed close together in the array to provide output illumination for a surface. US-A-2005/213321 describes a full colour light source that uses R, G, B LED elements as a single light source, the LED elements being arranged in triplets, one for colour.

The colour of the overall illumination provided by multi-coloured luminaires is produced to mixing the output of the R, G, B LED elements in different relative proportions. By changing the relative proportions of the light generated by the R, G and B LED elements, changes in the overall colour of the illumination are obtained. White (W) and amber (A) LED elements may also be used in addition to the conventional R, G and B elements. The relative ratios of the light output by the LED elements are controlled to define the base-colour brightness produced. Typically, the LED elements are arranged in regular patterns within the array, namely, as repeated lines or columns within the array. For example, a sequence of RGB, RGBW or RGBA colours can be repeated many times within the array.

One luminaire with coloured LED elements is described in WO-A-2010/004495 where LED triplets of R, G and B LED elements are used to provide illumination, each triplet being controlled to provide static white illumination as well as dynamic or general lighting that can be dimmed and changed in colour temperature. White and/or amber LED elements can be used with the triplets and can be individually dimmed to produce colours of the rainbow.

However, many coloured LED arrays used in luminaires tend to provide non-homogeneous and non-uniform illumination particularly around the edges of the light beam produced. Moreover, such coloured LED arrays tend not to be scalable as they are based on either a 3×3 module (where R, G and B LED elements only are used) or a 4×4 module (where R, G, B and W (or A) LED elements are used). Such modules cannot readily be repeated whilst maintaining a homogeneous and uniform output except in multiples of 4 modules, 9 modules, 16 modules, 25 modules etc. which provide luminaire arrays having a substantially square profile.

SUMMARY OF THE INVENTION

It is therefore an object of the present invention to provide an LED luminaire from which homogeneous and uniform illumination is produced.

It is another object of the present invention to provide a luminaire LED module that is readily scalable whilst providing the same homogeneous and uniform illumination.

In accordance with a first aspect of the present invention, there is provided a light array comprising a plurality of coloured light-emitting diode elements, the plurality of coloured light-emitting diode elements being dispersed within the array so as to provide a uniform colour output.

By dispersing the coloured light-emitting diode elements throughout the light array, the colour banding produced by arranging the coloured light-emitting diode elements in regular patterns within the array is substantially prevented.

Ideally, equal numbers of each coloured light-emitting diode element are dispersed throughout the array.

In one embodiment, four colours of light-emitting diode elements are arranged within the light array. Preferably, the coloured light-emitting diode elements are red, green, blue and white.

It is preferred that the red light-emitting diode elements are grouped towards the centre of the array. This has the advantage of reducing a corona effect where a ring of red light is produced around the central beam.

In a preferred embodiment, the light array comprises twenty-four light-emitting diode elements arranged in a rectangle having a long edge and a short edge.

In accordance with another aspect of the present invention, there is provided a luminaire comprising at least one light array as described above.

As each light array forms a repeatable module, where more than one light array is required, the light arrays may be arranged side by side with either their long edges adjacent one another or their short edges adjacent one another.

The luminaire may comprise light arrays arranged in more than one row. The term "row" is intended to include "column" as the light arrays can be implemented as rows or columns.

In one embodiment, the luminaire may include at least one light array comprising a mirror image of another light array. The mirror image may be formed about the long edge of the light array, or the short edge of the light array.

Additionally, the luminaire may comprise a square array which comprises at least six light arrays.

BRIEF DESCRIPTION OF THE DRAWINGS

For a better understanding of the present invention, reference will now be made, by way of example only, to the accompanying drawings in which.

DESCRIPTION OF THE INVENTION

Figure 1A:
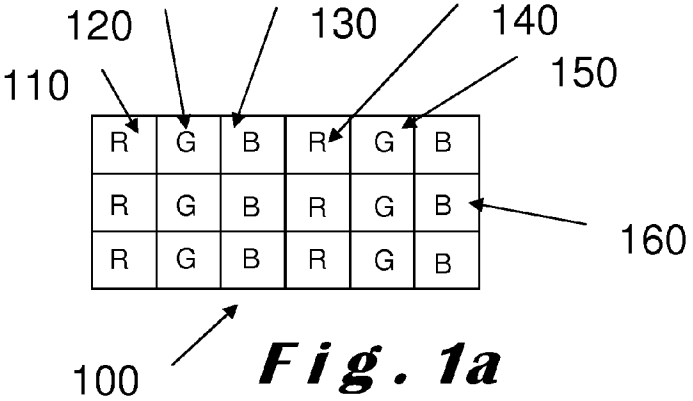
FIG. 1*a* illustrates a luminaire array module having vertically aligned coloured LED elements.

The present invention will be described with respect to particular embodiments and with reference to certain drawings but the invention is not limited thereto. The drawings described are only schematic and are non-limiting. In the drawings, the size of some of the elements may be exaggerated and not drawn on scale for illustrative purposes.

It will be understood that the terms "vertical" and "horizontal" are used herein refer to particular orientations of the Figures and these terms are not limitations to the specific embodiments described herein.

When the LED elements are arranged in vertical lines of the same colour within the array, the output produced tends not to be homogeneous and uniform. For example, in an array comprising R-G-B LED elements arranged such that the R, G and B LED elements in vertically aligned columns (or horizontally aligned rows) tends to produce illumination having variations in tints or shades of white across the surface being illuminated. The visual perception of the illuminated surface tends to be poor as the colours may appear as bright strips separated by dark areas (banding), and the resulting effect is an apparent underused emitting surface, that is, only a part of the surface appears to be emitting light. Moreover, the overall quality of the emitted light may be poor due to incorrect mixing of the coloured light in different zones of the surface to be illuminated. In addition, colour mixing is also poor as geometrical patterns corresponding to the arrangement of the LED elements within the luminaire may be clearly visible and the light beam and its associated footprint may appear to move in space as the colours are changed. An array of coloured LED elements arranged in vertical lines or columns and the associated banding effect is described below with reference to FIGS. 1*a*, 1*b*, 1*c*, 1*d* and 1*e*.

FIG. 1*a* illustrates a conventional luminaire array 100 comprising 18 coloured LED elements arranged in vertical lines or columns 110, 120, 130, 140, 150, 160 within the array 100. As shown, array 100 comprises only R, G and B coloured LED elements, but it will be appreciated that LED elements of other colours, for example, W and/or A, may also be included in between the R, G and B vertical lines or columns if required.

Figure 1B:
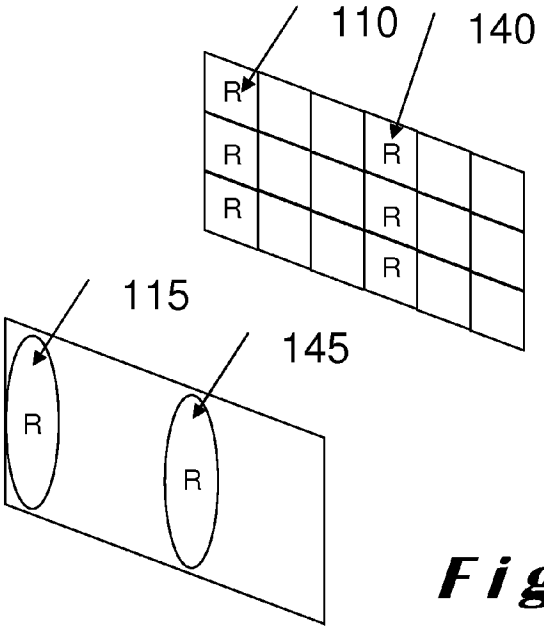
FIG. 1*b* illustrates the output from the R LED elements only for the FIG. 1*a* array module.
Figure 1C:
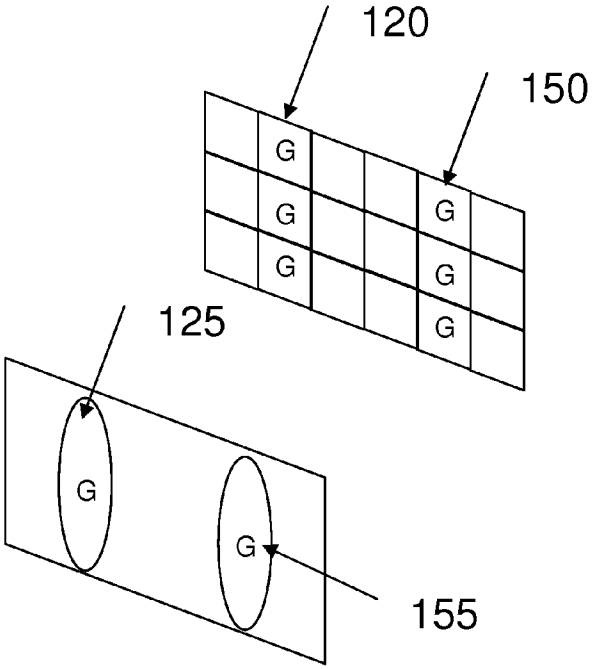
FIG. 1*c* illustrates the output from the G LED elements only for the FIG. 1*a* array module.

In FIG. 1*b*, the output 115, 145 from the R LED elements in vertical lines or columns 110, 140 only is shown. Similarly, FIG. 1*c* illustrates the output 125, 155 from G LED elements in vertical lines or columns 120, 150 only, and FIG. 1*d* illustrates the output 135, 165 from the B LED elements in vertical lines or columns 130, 160 only.

Figure 1E:
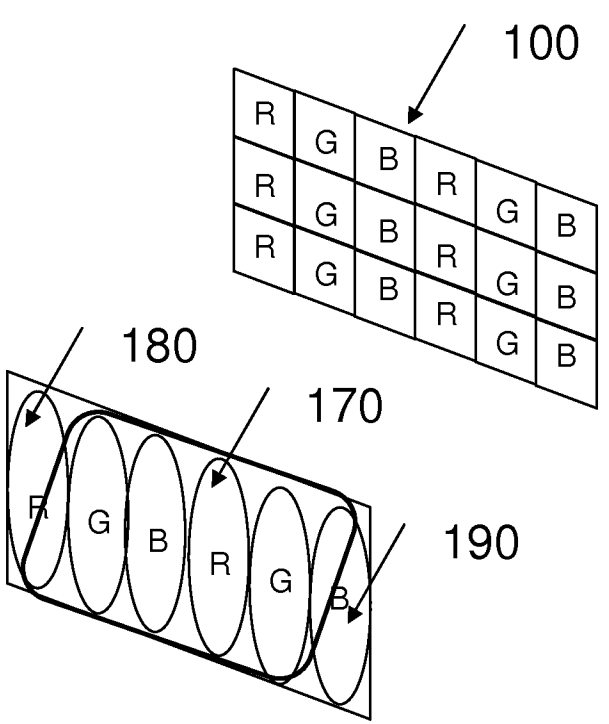
FIG. 1*e* illustrates the output from the luminaire array module of FIG. 1*a;*
Figure 1D:
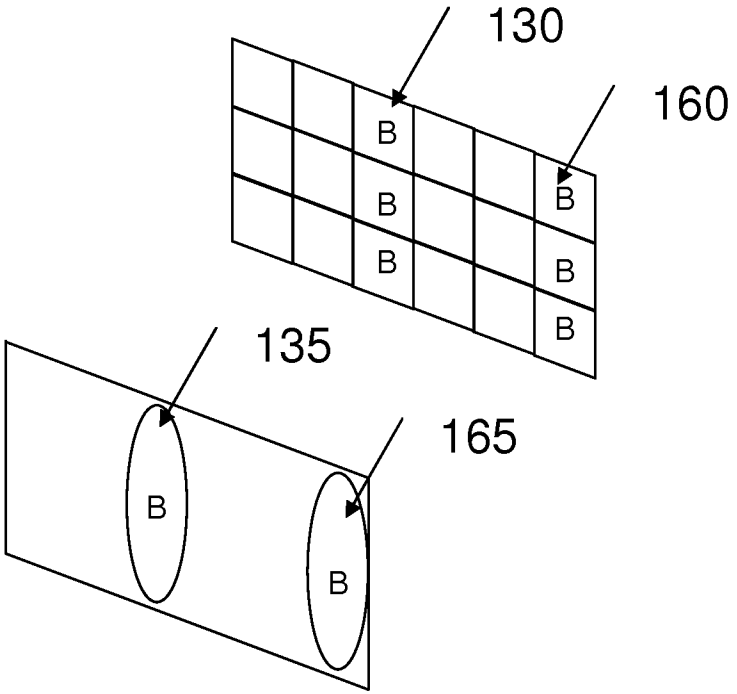
FIG. 1*d* illustrates the output from the B LED elements only for the FIG. 1*a* array module.

FIG. 1*e* illustrates the output from the array 100 and shows that, due to mixing of the output from the LED elements, a central region 170 is obtained where substantially white light is obtained with a reddish white light 180 being obtained at one end due to the R LED elements in column 110 and a bluish white light 190 being obtained at the other end due to the B LED elements in column 160.

FIGS. 1*b*, 1*c*, 1*d* and 1*e* illustrate the banding effect obtained due to the vertically aligned coloured LED elements. Although the array 100 shows the LED elements arranged in vertical lines, the same problem arises where the coloured LED elements are arranged in horizontal lines or rows.

A partial solution to the problem of colour banding when the array comprises coloured LED elements arranged in either vertically aligned columns or horizontally aligned rows, is to arrange the coloured LED elements diagonally within the luminaire In this arrangement, LED elements of the same colour use a larger horizontal/vertical surface which appears to lower the emitted light density. This is because the pitch or distance between LEDs of the same colour on the diagonal is greater than that of the LEDs of the same colour in the horizontal or vertical directions. However, whilst the visual perception of the illuminated surface is improved, it is still not ideal as the banding is now on the diagonal and has a lower perceivable impact. Whilst the colour mixing is improved, the light beam and its associated footprint still appear to move in space as the colours are changed. An array of coloured LED elements arranged in diagonals and the associated banding effect is described below with reference to FIGS. 2*a*, 2*b*, 2*c*, 2*d* and 2*e*.

Figure 2A:
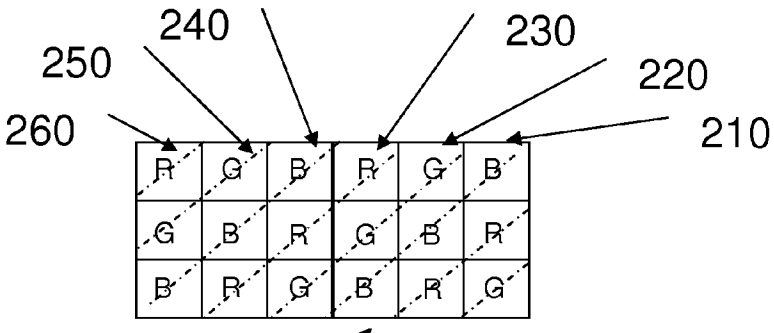
FIG. 2*a* illustrates a luminaire array module having diagonally aligned coloured LED elements.

FIG. 2*a* illustrates a luminaire array 200 comprising 18 coloured LED elements arranged in diagonals 210, 220, 230, 240, 250, 260 within the array 200. Only four full diagonals 210, 220, 230, 240 are shown. As shown, array 100 comprises only R, G and B coloured LED elements, but it will be appreciated that LED elements of other colours, for example, W and/or A, may also be included as diagonal lines in between the R, G, and B diagonals if required.

Figure 2B:
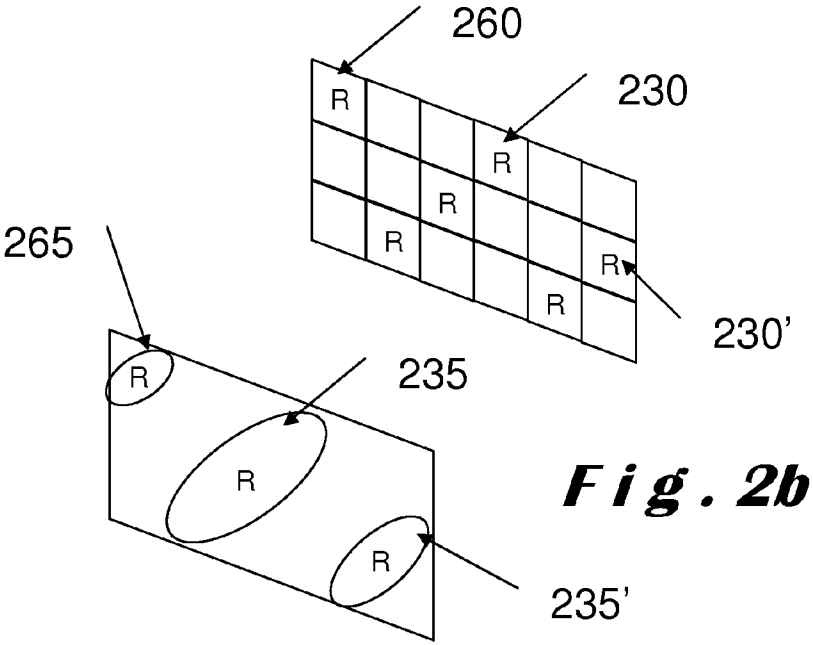
FIG. 2*b* illustrates the output from the R LED elements only for the FIG. 2*a* array module.
Figure 2C:
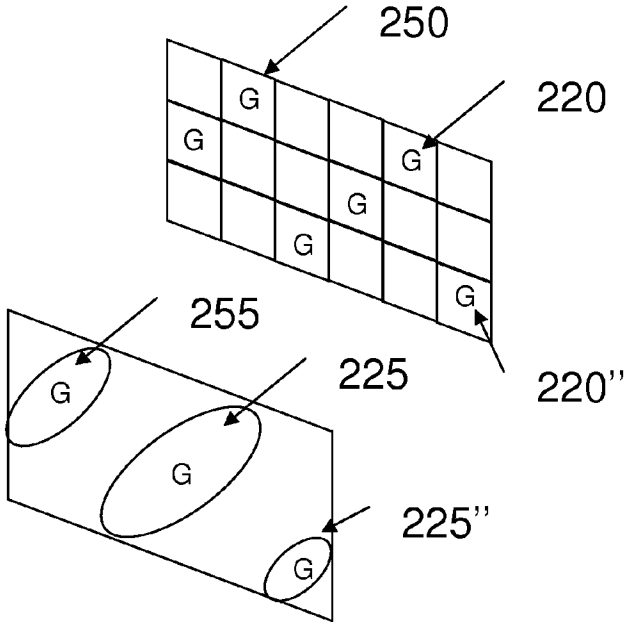
FIG. 2*c* illustrates the output from the G LED elements only for the FIG. 2*a* array module.

In FIG. 2*b*, the output 235 from R LED elements in full diagonal 230 is shown together with outputs 225", 265 corresponding to LED elements in partial diagonals 230', 260 as shown. Similarly, FIG. 2*c* illustrates the output 225 from G LED elements in full diagonal 220 together with outputs 225", 255 corresponding to partial diagonals 220", 250, and FIG. 2*d* illustrates the output 215, 245 from the B LED elements on full diagonals 210, 240.

Figure 2E:
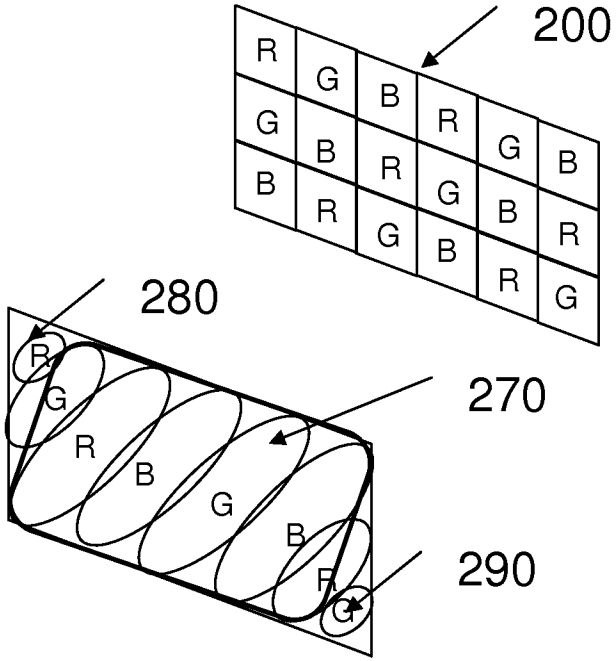
FIG. 2*e* illustrates the output from the luminaire array module of FIG. 2*a;*
Figure 2D:
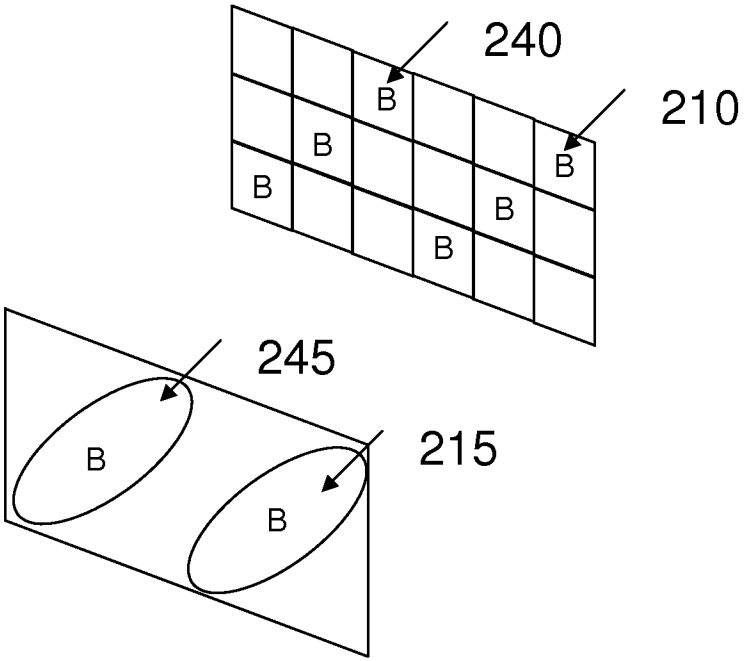
FIG. 2*d* illustrates the output from the B LED elements only for the FIG. 2*a* array module.

FIG. 2*e* illustrates the output from the array 200 and shows that, due to mixing of the output from the LED elements, a central region 270 is obtained where substantially white light is obtained with a reddish white light 280 being obtained at one end due to the partial R diagonal 260 and a greenish white light 290 being obtained at the other end due to the partial G diagonal 220".

FIGS. 2*b*, 2*c*, 2*d* and 2*e* illustrate the banding effect obtained due to the diagonally aligned coloured LED elements. In comparison with the output produced by vertically aligned LED elements shown in FIG. 1*e*, the output produced by the diagonally aligned LED elements shown in FIG. 2*e* has a larger substantially white area 270 with smaller reddish white and greenish white areas 280, 290.

In addition to the geometrical effects shown in FIGS. 1*e* and 2*e* provided by the arrays shown in FIGS. 1*a* and 2*a*, secondary lenses are used to create the desired output beam. However, such secondary lenses influence the illumination footprint as different coloured light beams passing through them are refracted differently and hence tend not have the same footprints.

Coloured light beams are in fact characterised by different photometric curves so that two types of effect are obtained according to the different colours when using a secondary lens. [A photometric curve is a graph of the distribution of the luminous intensity emitted from a source.] These two types of effect are different half-flux openings and different residual flux openings, the latter being 10% or 20% of the nominal flux along a central axis of the lens. The openings (or apertures) correspond to the value of the geometrical angle of the light cone coming out from the tens. The overall perceived effect is that the correct mixing is obtained only in a central area of the beam footprint whilst the outer corona is always characterised by a prevalence of a specific colour, for example, a reddish corona around a central area with good colour mixing.

In addition to the problems described above in relation to banding and visual perception, another common problem with regular patterns for the coloured LED elements in luminaires is the inability to create larger luminaires by replicating a base module of coloured LED elements as described above, as the geometrical aspects only allow replication when the module is squared, that is, each side is as long as the number of colours required. For example, if a diagonal arrangement of the coloured LED elements is used, and three colours are required, then the base module has a size of 3 LED elements by 3 LED elements with colour sequences in the lines of: RGB, GBR and BRG. If four colours are required, the base module is 4 LED elements by 4 LED elements with colour sequences in the lines of: RGBW, GBWR, BWRG and WRGB. Only when this base module rule is respected, a larger luminaire can be made by placing many modules close to one another. This means that a base module that is not effectively a square as described above cannot be used as the illumination will always appear to be non-homogeneous.

In accordance with the present invention, the problems described above can be overcome. The placement of each coloured LED element is such that individual coloured LED elements are dispersed over the whole surface of the array not following any regular vertical, horizontal or diagonal patterns. This readily reduces the effect of banding and improves visual perception as "unused" zones where all colours are not used are effectively eliminated. For the scalability, non-square modules can be used in which the placement of coloured LED elements is such that the colour are dispersed over the whole surface as will be described in more detail below. The corona effect can be reduced by placing the R LED elements towards the centre of each module.

Figure 3A:
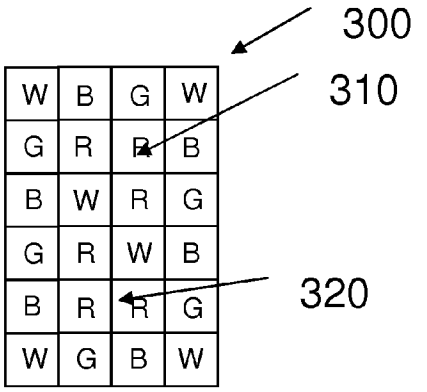
FIG. 3*a* illustrates a luminaire array module in accordance with the present invention.

It has been determined that a 4×6 array can be used where 6 LED elements of R, B, G and W can be placed within the array to provide improved results. In FIG. 3*a*, a 4×6 array 300 is shown where the coloured LED elements are arranged in distributed pattern within the array. As shown, the six R LED elements are grouped in two groups 310, 320 of three LED elements each and each group 310, 320 is located towards the centre of the array 300, and the other LED elements are distributed through the array with no other LED elements being grouped within the array. Such an array 300 forms a base module which can be replicated to provide scalability.

Figure 3B:
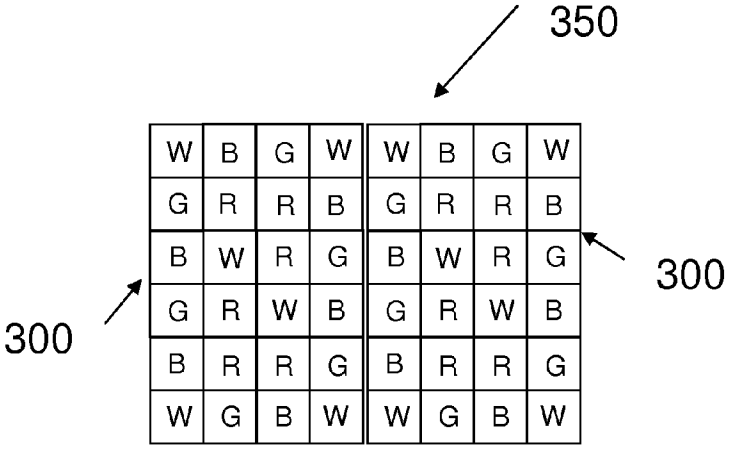
FIG. 3*b* illustrates a luminaire array comprising two modules as shown in FIG. 3*a*.
Figure 3C:
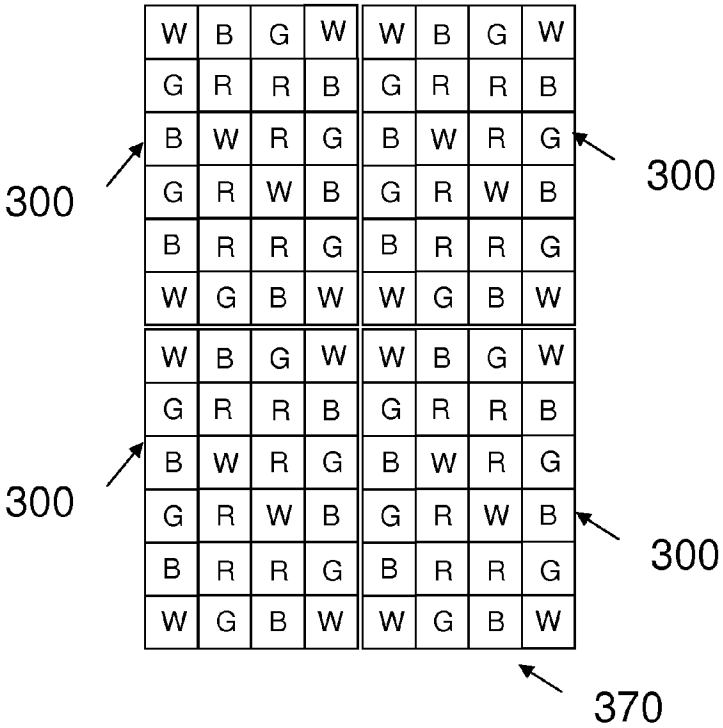
FIG. 3*c* illustrates a luminaire array comprising four modules as shown in FIG. 3*a*.

In FIG. 3*b*, an array 350 comprising two identical modules 300 is shown arranged with their long edges adjacent one another to form an 8×6 array. In the illustrated orientation, the array has 8 columns and 6 rows. In FIG. 3*c*, an array 370 is shown that comprises an 8×12 array comprising two arrays 350 or four identical modules 300.

In addition, although the illustrated base array 300 is shown forming an 8×6 array as shown in FIG. 3*b*, it will readily understood that a 4×12 array can be formed if the modules 300 are placed together with their short edges adjacent one another.

It will be appreciated that, as the base module is rectangular, other rectangular luminaires are possible including square luminaires. For example, a square 12×12 array can be formed by six arrays 300 arranged in a 3×2 formation, that is, three arrays across by two arrays down in the particular orientation shown in FIG. 3*a*. Square arrays of other multiples of both 4 and 6 can be implemented, for example, 24×24, 48×48, 96×96 etc.

The array or module 300 can be used either horizontally or vertically and can be replicated as described above with reference to FIGS. 3*b* and 3*c*. Advantageously, no geometrical strip lines are perceivable when in direct view when four colours are used. The colour provided by each LED element appears to occupy the maximum surface possible without the need for grouping. Moreover, as each colour is sparsely distributed within the array, the power density is advantageously distributed across the array and hot spots are substantially reduced or eliminated. This enables the array to have a lower operating temperature thereby improving reliability and life span of the array. Only R LED elements are grouped towards the centre of the array to compensate for their effective wider beam when passing through a secondary lens. R LED elements provide an aperture greater than that obtained for the other colours, that is, G or B, and W due to its higher residual flux.

Although the arrays shown in FIGS. 3*b* and 3*c* are repetitions of a base array having a particular LED arrangement, it will be appreciated that these arrays may also be implemented using the array of FIG. 3*a* and its mirror image about its long and/or short edges.

In a specific implementation of the present invention, it was found that better colour mixing was obtained at very low distances from the luminaire, for example, less than 1 m, when Cree XP-E LED elements are used together with Gaggione lenses LL5. However, other LED elements and lenses can also be used.

Whilst the present invention has been described with reference to a specific embodiment, it will be appreciated that other embodiments are also possible.

The invention claimed is:

1. A light array, comprising:

a plurality of colored light-emitting diode elements dispersed within a light array and configured to provide a uniform color output;

wherein said plurality of colored light-emitting diode elements comprises six red light-emitting diode elements, six green light-emitting diode elements, six blue light-emitting diode elements and six white light-emitting diode elements, wherein said white light-emitting diode elements each compromise at least one light emitting diode in a structure configured to emit white light;

wherein said red, green, blue and white light-emitting diode elements are arranged to form a 4×6 rectangle in said light array with said red light-emitting diode elements being located towards a center of said light array, wherein said six red light-emitting diodes are grouped in two groups that each compromise three of the red light-emitting diode elements and one of the white light-emitting diode elements to form a central part of said 4×6 rectangle that is surrounded by said six blue light-emitting diode elements and said six green light-emitting diode elements and a remaining four of said white light-emitting diode elements, said remaining four of the white light-emitting diode elements being located at each corner of said 4×6 rectangle; and wherein said 4×6 rectangle has a long edge defined by six of the plurality of colored light-emitting diode elements and a short edge defined by four of the plurality of colored light-emitting diode elements.

2. A light array according to claim 1, wherein each of said groups of three red light-emitting diodes define diagonally opposed corners of a 2×4rectangle within said 4×6 rectangle.

3. A luminaire, comprising:

at least one light array comprising a plurality of colored light-emitting diode elements dispersed within said at least one light array and each of said at least one light array being configured to provide a uniform color output;

wherein, in each of said at least one light array, said plurality of colored light-emitting diode elements comprises six red light-emitting diode elements, six green light-emitting diode elements, six blue light-emitting diode elements and six white light-emitting diode elements, wherein said white light-emitting diode elements each compromise at least one light emitting diode in a structure configured to emit white light;

wherein said red, green, blue and white light-emitting diode elements are arranged to form a 4×6 rectangle in each of said at least one light array with said red light-emitting diode elements being located towards a center of each of said at least one light array, wherein said six red light-emitting diode elements are grouped in two groups that each compromise three of the red light-emitting diode elements and one of the white light-emitting diode elements to form a central part of said 4×6 rectangle that is surrounded by said six blue light-emitting diode elements and said six green light-emitting diode elements and a remaining four of said white light-emitting diode elements, said remaining four of the white light-emitting diode elements being located at each corner of said 4×6 rectangle; and wherein each 4×6 rectangle of said at least one light array has a long edge defined by six of the plurality of colored light-emitting diode elements and a short edge defined by four of the plurality of colored light-emitting diode elements.

4. A luminaire according to claim 3, wherein said at least one light array comprises two or more light arrays arranged side by side with their long edges adjacent one another.

5. A luminaire according to claim 4, wherein said two or more light arrays are arranged in more than one row.

6. A luminaire according to claim 4, wherein said two or more light arrays are identical.

7. A luminaire according to claim 4, wherein two of said two or more light arrays are configured to be a mirror image of another.

8. A luminaire according to claim 7, wherein said mirror image is formed about said long edge of each of said two light arrays.

9. A luminaire according to claim 7, wherein said mirror image is formed about said short edge of each of said two light arrays.

10. A luminaire according to claim 3, wherein said at least one light array comprises two or more light arrays arranged side by side with their short edges adjacent one another.

11. A luminaire according to claim 10, wherein said two or more light arrays are arranged in more than one row.

12. A luminaire according to claim 10, wherein said two or more light arrays are identical.

13. A luminaire according to claim 10, wherein said two of said two or more light arrays are configured to be a mirror image of another.

14. A luminaire according to claim 13, wherein said mirror image is formed about said long edge of each of said two light arrays.

15. A luminaire according to claim 13, wherein said mirror image is formed about said short edge of each of said two light arrays.

16. A luminaire according to claim 3, comprising at least six of the light arrays that are arranged into a square array compromising edges defined by equal total numbers of the plurality of colored light-emitting diode elements of the at least six of the light arrays.

* * * * *